United States Patent [19]

Buchan et al.

[11] 3,947,113

[45] Mar. 30, 1976

[54] ELECTROPHOTOGRAPHIC TONER TRANSFER APPARATUS

[75] Inventors: William Raymond Buchan, Lincoln; James A. Kulpan, Roslindale; Edward Francis Mayer, Acton, all of Mass.

[73] Assignee: Itek Corporation, Lexington, Mass.

[22] Filed: Jan. 20, 1975

[21] Appl. No.: 542,155

[52] U.S. Cl. ..... 355/3 R; 96/1.4; 198/208

[51] Int. Cl.[2] ..... G03G 15/16

[58] Field of Search..... 355/3 R, 3 DR, 3 TR, 3 BE; 198/208, 202; 96/1.4

[56] References Cited

UNITED STATES PATENTS

| | | | |
|---|---|---|---|
| 2,990,278 | 6/1961 | Carlson | 355/37 R X |
| 3,591,276 | 7/1971 | Byrne | 355/3 TR |
| 3,792,924 | 2/1974 | Matsuda et al. | 355/3 BE |
| 3,893,761 | 7/1975 | Buchan et al. | 355/3 R |

OTHER PUBLICATIONS

"Improved Electro. Printing App. and Method 12933," Eastman Kodak Research Dis., Jan. 1975, pp. 21, 22.

*Primary Examiner*—Robert P. Greiner

*Attorney, Agent, or Firm*—Homer O. Blair; Robert L. Nathans; David E. Brook

[57] ABSTRACT

An improved apparatus is disclosed for transferring toner from the surface of a toner-bearing drum, such as a xerographic drum, to a support medium for the toner, such as plain paper. The improvement relates to apparatus of the type which employs a transfer web or belt to remove toner from the toner-bearing drum and to transfer it to a support medium. In such apparatus, it is typical for the transfer web to be at least partially driven by means of its contact with the toner-bearing drum and/or transfer rollers.

The improvement described herein comprises providing means for simultaneously disengaging the toner-bearing drum and at least one of the transfer rollers from the transfer web at least once per web cycle, and also providing means for mechanically correcting web alignment and registration while the toner-bearing drum and transfer roller are disengaged. Suitable means for disengaging the toner-bearing drum and transfer roller include the provision of indented surfaces on the drum and transfer roller. Suitable means for mechanically correcting web alignment and registration includes an independent driving means, such as a chain drive, for the transfer web. Thus, in this embodiment, the indented portions of the toner-bearing drum and transfer roller simultaneously disengage the web which is forced back into proper alignment and registration by the chain drive.

16 Claims, 5 Drawing Figures

PRIOR ART
FIG. 1.
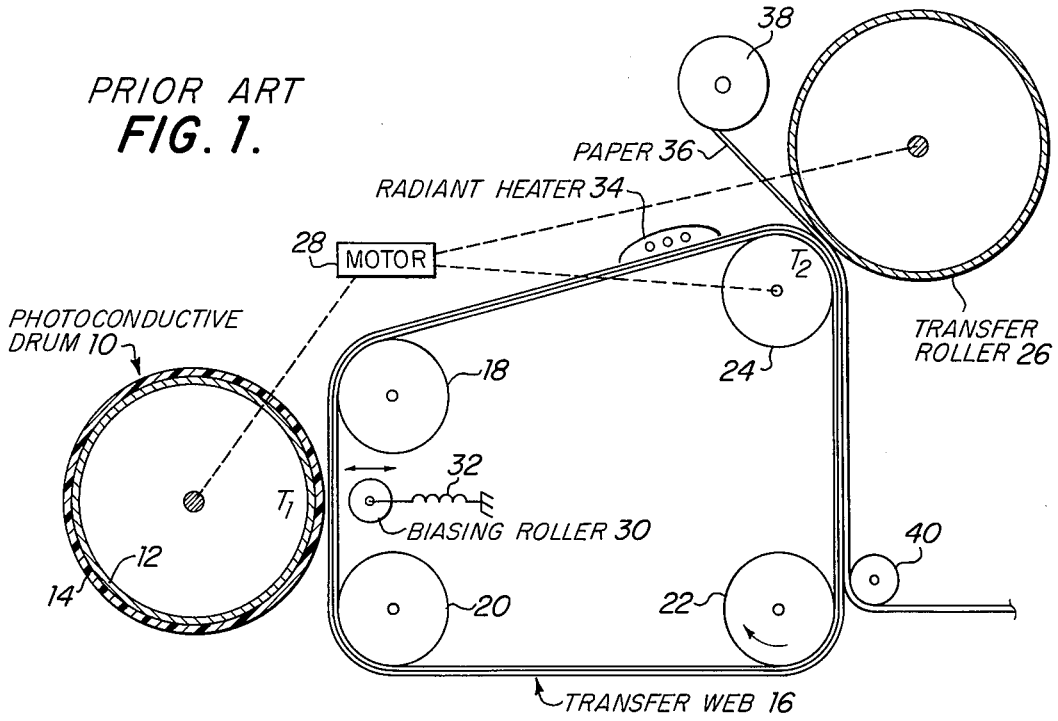
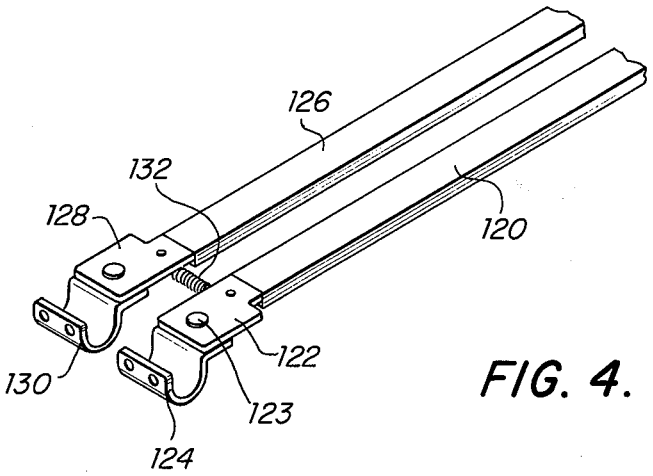
FIG. 4.
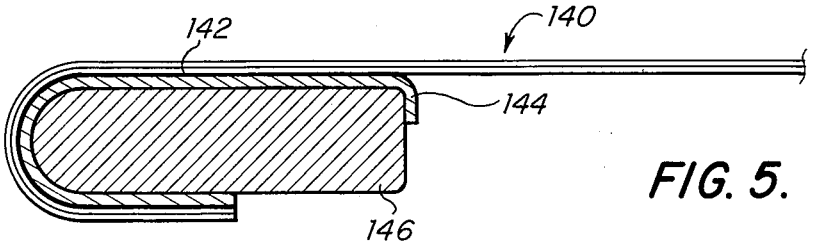
FIG. 5.

ELECTROPHOTOGRAPHIC TONER TRANSFER APPARATUS

BACKGROUND OF THE INVENTION

1. Field of the Invention

This invention relates to an electrophotographic transfer apparatus and more particularly to an improved electrophotographic toner transfer apparatus of the type which employs a transfer web or belt.

2. Description of the Prior Art

In customary electrophotographic processes, a conductive backing having a photoconductive insulating layer thereon is electrostatically imaged by first uniformly charging its surface, and subsequently exposing the charged surface to a pattern of activating electromagnetic radiation, such as light. The radiation pattern selectively dissipates electrostatic charges in the illuminated areas on the photoconductive surface, which results in a latent electrostatic image in non-illuminated areas. This latent electrostatic image can be subsequently developed to form a visible image by depositing solid electrophotographic developer materials thereon by a variety of development techniques, the most common of which is cascade development. The developed toner image is typically transferred and fused to another substrate such as plain paper.

Transfer of the toner image to the paper can be achieved in a number of ways, and one such method involves the use of an intermediate transfer web or belt. See, for example, Carlson, U.S. Pat. No. 2,990,278; Byrne, U.S. Pat. No. 3,591,276; and, co-pending U.S. patent application Ser. No. 403,696, filed Oct. 4, 1973. Although the term "web" will be used hereinafter, it is used to include belts and other similar transfer members.

A serious problem which has developed in use of intermediate transfer webs is the requirement to accurately track the web. Such webs are usually driven by a series of rollers, and their longitudinal alignment is often thrown off because the web tends to "walk" around the rollers. This effect is cumulative and it interferes with accurate registration of the system. Additionally, webs tend to wander from side to side on their rollers which also results in misalignment problems.

Methods are known for reducing alignment errors, or for correcting them. Heretofore, however, such methods have either been complicated or impractical. For example, one solution involves the utilization of crowned rollers to drive the belt which reduces tracking errors. Nevertheless, such crowned rollers do not totally eliminate misalignment problems, and since the effect is cumulative, the amount of registration error introduced becomes significant after many cycles, even though the error per cycle is exceedingly small. Additionally, crowned rollers make belt replacement and maintenance a complicated operation.

Alternatively, electronic sensing means can be used to detect misalignment errors. As would be expected, such electronic means are relatively expensive and usually require the copier to be shut down after a tracking error of a certain magnitude is detected so that an operator can manually correct the error. This requirement for frequent servicing with concomittant downtime is highly undesirable in the office copier field.

SUMMARY OF THE INVENTION

The invention relates to an electrophotographic toner transfer apparatus of the type wherein an intermediate transfer web is used to transfer toner from the surface of a toner-bearing drum, such as a photoconductive drum, to a support medium, such as plain paper. In such systems, the transfer web is typically at least partially driven by means of the toner-bearing drum and/or transfer rollers. This is usually achieved by passing the web through nips at the toner-bearing drum and transfer rollers. The specific improvement of this invention is the provision of both a means for simultaneously disengaging the nips at the drum and at the transfer rollers and a means for mechanically correcting transfer web alignment and registration while the belt is so disengaged. Mechanical correction of web alignment and registration occurs once per belt cycle.

In one embodiment, a photoconductive drum and one of the transfer rollers have indentations in their outer surfaces which automatically serve to disengage the web once per revolution. An independent drive system for the web, such as a chain drive, is provided which takes over the function of driving the web while the drum and transfer roller are disengaged therefrom. Thus, if the belt is accurately joined to the chain drive system, it is forced back into accurate alignment and registration each time the drum and transfer roller are disengaged. Thus, alignment and registration are mechanically but automatically corrected during each cycle of the web. Moreover, it is convenient to use joints to fasten the transfer web to the chain drive, and indented surfaces on the drum and transfer roller can be synchronized with these joints thereby eliminating problems caused by contact between joints and the drum or transfer roller surfaces, which would be present if indented surfaces or other equivalent disengaging means were not used.

BRIEF DESCRIPTION OF THE DRAWINGS

FIG. 1 is a schematic illustration of a web transfer apparatus of the prior art;

FIG. 4 is a perspective view of one suitable joining mechanism for securing segmented transfer webs to an independent chain drive; and, FIG. 5 is an end view illustrating how a transfer web can be joined to a bar which in turn could be inserted in an independent chain drive.

DESCRIPTION OF THE PREFERRED EMBODIMENTS

Figure 2:
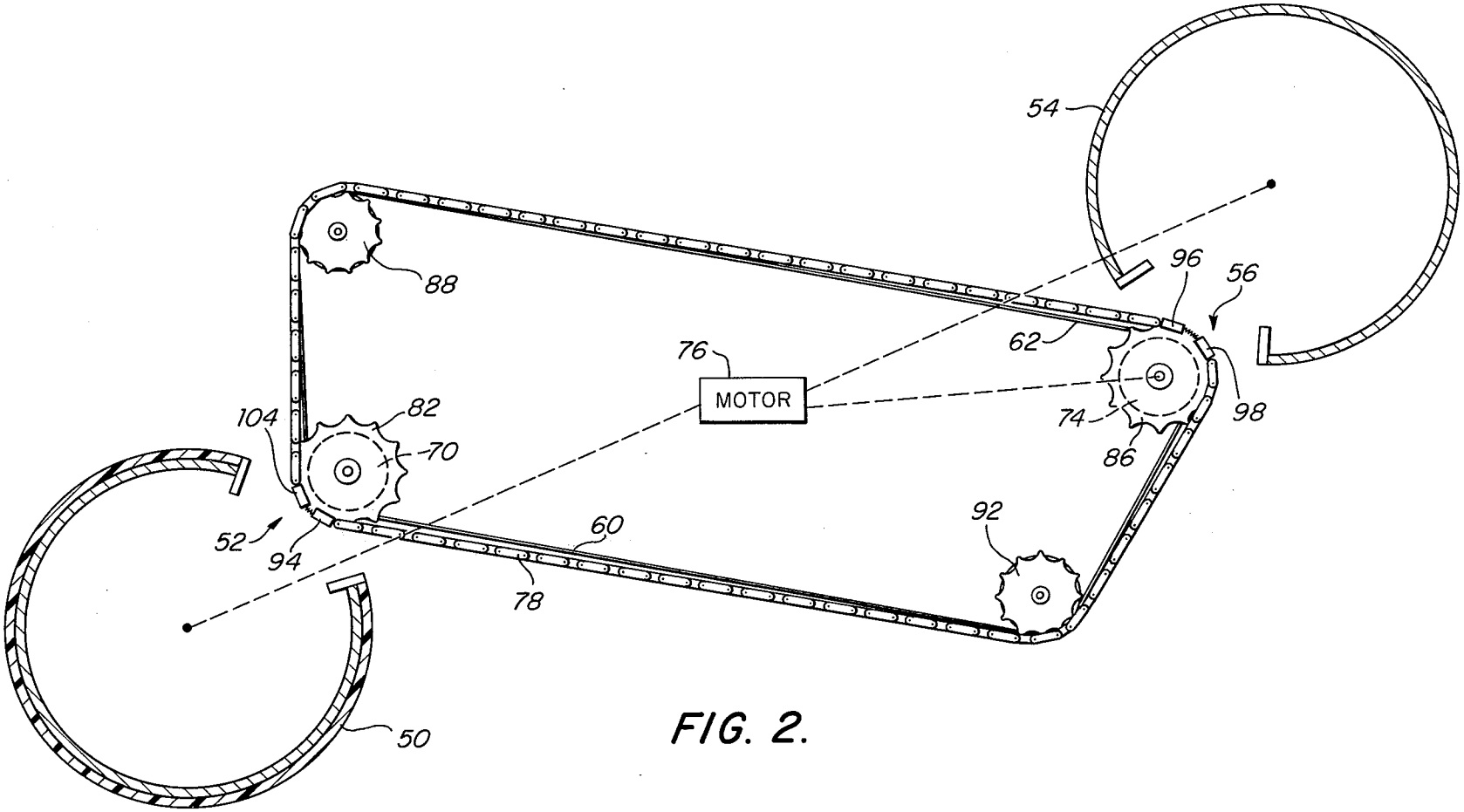
FIG. 2 is a schematic illustration of a web transfer apparatus according to this invention.

Referring now to the Figures in more detail, FIG. 1 illustrates, in schematic form, a web transfer apparatus of the prior art. Photoconductive drum 10 is formed from a conductive substrate 12, typically aluminum, and has a photoconductive insulating coating 14 thereon, such as vitreous selenium. Photoconductive drum 10 is typical of those used in xerographic copiers; other electrophotographic copier apparatus usually stationed around the drum, such as corona charging apparatus, imaging stations and developer stations are omitted from the illustration for simplicity and since they are not directly relevant to this invention. Intermediate transfer web 16 is trained to pass in an endless loop around rollers 18, 20, 22 and 24. Transfer roller 26 is provided opposite roller 24 to provide a suitable nip therebetween for transferring toner from web 16 to a support medium. Web 16 can be driven, for example, by motor 28 which is connected by gears or other suitable linking mechanisms to drum 10, roller 24, and transfer roller 26, which are all driven in a clockwise direction with the same peripheral speed.

In such systems, there are two transfer points. The first, indicated as $T_1$, occurs at a nip formed between photoconductive drum 10 and biasing roller 30, which can be moved into and out of a contacting relationship with web 16 by tensioning spring 32. At $T_1$, toner is removed from the surface of photoconductive drum 10 by transfer web 16 when biasing roller 30 is moved into pressure contact with web 16. In some systems, substantially all of the toner on the surface of photoconductive drum 10 is transferred, whereas in other systems, it is preferred to transfer only a portion of the toner from photoconductive drum 10 to web 16.

Typically in electrophotographic copiers, toner residing on the surface of transfer web 16 is heaated to a molten state. This can be accomplished, for example, by radiant heater 34. Molten toner is then transferred to a support medium, such as paper 36, which is supplied to the nip between rollers 24 and 26 by paper roll 38.

The second transfer point, indicated as $T_2$, occurs at the nip between rollers 24 and 26. Typically, after the molten toner is transferred to paper 36, it becomes fused thereon after which paper 36 can be removed from contact with transfer web 16 by paper removal roller 40. The paper with the fused image thereon can then be cut to length to form the desired copies.

Figure 3:
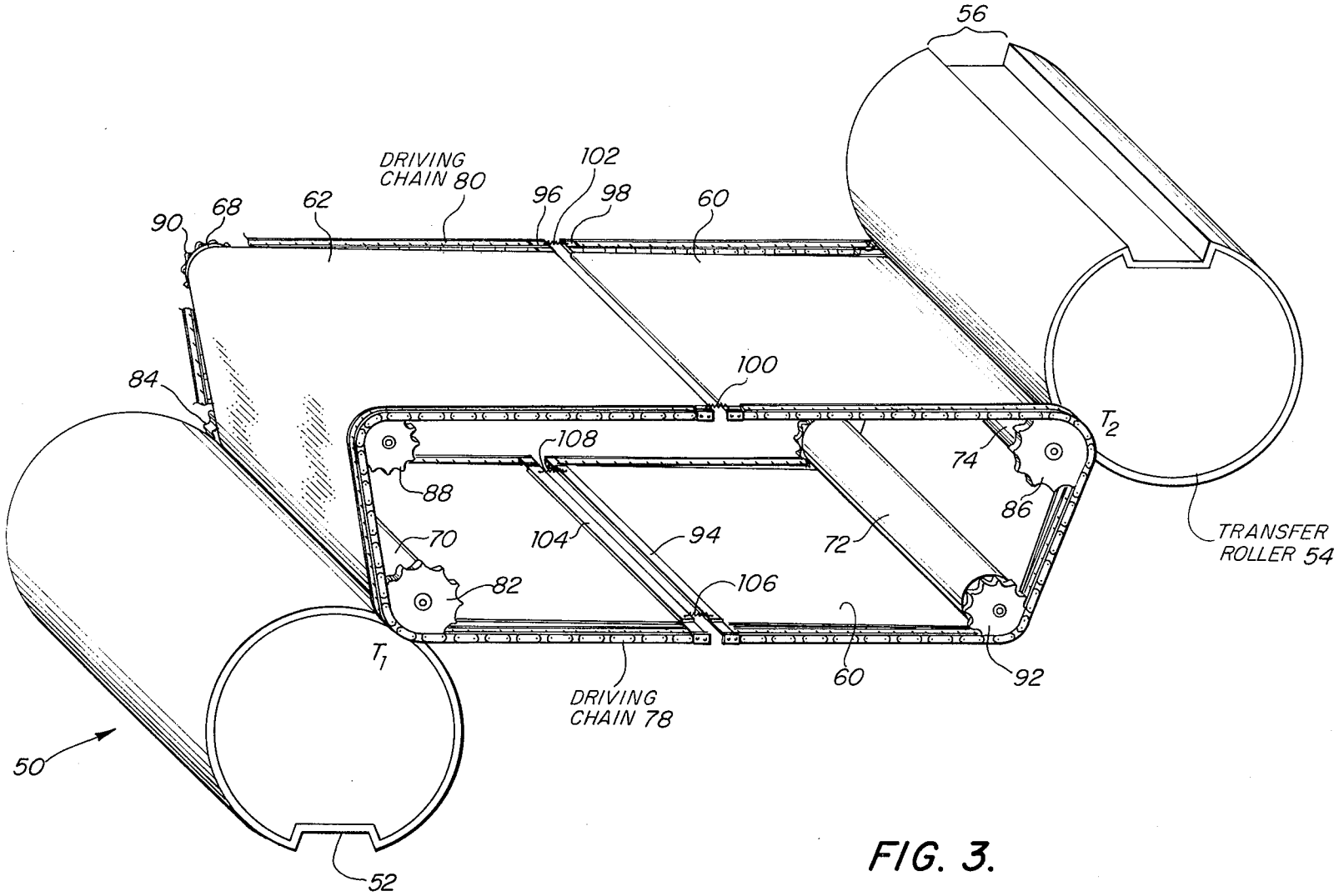
FIG. 3 is a perspective view of a web transfer apparatus according to this invention.

A web transfer apparatus according to this invention is illustrated in FIGS. 2 and 3. Toner-bearing drum 50, which can be a photoconductive insulating drum such as drum 10 in FIG. 1, has an indented portion 52 cut into its outer surface. In a similar manner, transfer roller 54 has an indented portion 56 cut into its outer surface. The function of indented portions 52 and 56 will be discussed in detail infra.

A transfer web is formed from two independent segments, 60 and 62. These segments can be secured by bars or other equivalent means to form an endless loop which passes over web rollers 68, 70, 72 and 74. Web rollers 70 and 74 additionally serve to provide nips at $T_1$ and $T_2$ to provide for suitable toner transfer at these points.

The transfer web is at least partially driven by its contact with drum 50 and roller 70 at $T_1$ and rollers 74 and 54 at $T_2$. This can be achieved, for example, by providing a motor 76 which is suitably linked through gears or other mechanical linkage means to drive drum 50 and rollers 74 and 54 at the same peripheral speed.

In addition, an independent means for driving the web is also provided. Such independent means can comprise a chain drive system or other equivalent means. In FIGS. 2 and 3, chain drive system is illustrated consisting of drive chains 78 and 80 which are driven by sprockets positioned at the extremities of the web rollers.

In the embodiment illustrated in FIGS. 2 and 3, the various roller and sprocket sizes are designed to provide a preferred set of conditions. These conditions include a certain degree of slackness in the web before and after the nip between drum 50 and roller 70 which allows drum 50 to drive web 58 at the nip thereby providing for a rolling type of contact between web 58 and drum 50. Rolling contact is desirable to maintain high resolution toner images after transfer at $T_1$ and to avoid the generation of excessive amounts of triboelectric charges at $T_1$. Also, it is desirable to re-establish a tautness in the web as it passes from roller 68 to roller 74. This tends to keep the web flat and eliminate wrinkling as it passes through a heating zone prior to $T_2$.

To achieve the aforementioned conditions, sprockets 82 and 84 have a larger diameter than roller 70; sprocket 86 as well as the sprocket on the opposite end of roller 74 (not shown) also have a larger diameter than roller 74. Sprockets 88 and 90 have substantially the same diameter as roller 68; sprocket 92 as well as the sprocket at the opposite end of roller 72 (not shown) similarly have a diameter substantially equal to the diameter of roller 72. Additionally, the transfer web and chains 78 and 80 are fabricated to have substantially the same length.

As mentioned supra, web segments 60 and 62 can be secured to chains 78 and 80 by means of fastening bars. As illustrated, the leading edge of segment 60 is fastened to chains 78 and 80 by means of fastening bar 94. Similarly, the leading edge of web segment 62 is fastened to the chain drive system by bar 96. Bars 94 and 96 are fixedly mounted, so that the leading edge of web segments 60 and 62 is fixed with respect to chains 78 and 80. The trailing edges, on the other hand, are movably attached to the chain drive system. Thus, the trailing edge of segment 60 is movably secured to chains 78 and 80 by bar 98 which is movably attached to fixed bar 96 by springs 100 and 102. Similarly, the trailing edge of web segment 62 is movably secured to chains 78 and 80 by bar 104 which is movably attached to fixed bar 94 by springs 106 and 108. One method for providing the desired movable mountings for bars 98 and 104 is discussed infra.

With the arrangement illustrated, the web tends to become slightly slack prior to the nip at $T_1$ because it travels a shorter path than chains 78 and 80. Because of this, drum 50 is able to drive the web with rolling contact at $T_1$. After $T_1$, the slackness is removed as the springs snap the trailing edge of the web segments 60 and 62 back into place. Thus, the web is in a taut condition as it passes into the heating zone (not shown) prior to $T_2$.

Indented portions 52 and 56 of drum 50 and roller 54 are synchronized to meet the web at the joints formed by the fastening bars. Thus, the use of larger joints can be tolerated. More importantly, each time the indented portions 52 and 56 meet the web, drum 50 and roller 54 are disengaged from it. During such disengagement, the web is automatically and mechanically forced back into proper alignment and registration since chains 78 and 80 take over the web driving function and since the leading edges of web segments 60 and 62 are fixedly mounted to chains 78 and 80. Thus, any alignment and registration errors which are present are automatically and mechanically corrected during each transfer cycle. Preferably, each of web segments 60 and 62 have a length substantially equal to the periphery of drum 50 and transfer roller 54.

It should be understood that the apparatus illustrated in FIGS. 2 and 3 is only one specific embodiment among many which are possible. Those skilled in the art will be able to design many others, using no more than routine experimentation, to achieve any set of conditions which is desired.

In FIG. 4, suitable means for joining the bars which secure transfer web segments to a chain drive are illustrated. Bar 120 is used to movably secure the trailing edge of a web segment to a chain. A planar clip 122 having a pin hole arrangement 123 is integrally attached to bar 120 and is movably attached to U-shaped clip 124 which can be secured to a chain drive. Bar 126 is used to fixedly secure the leading edge of a web segment to a chain. Planar clip 128 is integrally attached to bar 126 and also to U-shaped clip 130 which can be movably secured to a chain drive. Movably mounted bar 120 is connected to fixedly mounted bar 126 by means of spring 132 which allows bar 120 to move. The pin and hole arrangement 123 allows bar 120 to move in accordance with the forces exerted on it and in accordance with the restraint exerted by spring 132.

FIG. 5 illustrates one embodiment for fastening transfer web to a mounting bar. Thus, transfer web 140 is bonded by an adhesive layer 142 to a clip 144 shaped so that it can be snapped into place over mounting bar 146. Any suitable adhesive can be used to bond web 140 to clip 144.

Suitable toner transfer webs for use with this invention can be formed from a wide choice of materials. In one particularly suitable web is formed from a substrate having an elastomeric coating thereon. Preferred elastomers have a surface free energy of 40 dynes/cm or lower, a hardness ranging from about 3 to 70 durometers and preferably 10–30 durometers (Shore A), and a surface which is smooth. Specific materials which are suitable include conductive and non-conductive silicone rubbers and flouroelastomers.

Since the web typically undergoes heating, it is desired to pick a substrate having an ultimate tensile strength of at least about 5,000 psi and a creep of below about 3 percent under a load of 1,000 psi at 175° C. One suitable material for the substrate is polyimide, which can be obtained in film form of suitable thickness from E. I. DuPont DeNemours & Company under the trademark Kapton. Other high temperature polymers might be used and might include, for example, polyaryl, sulfones, polyamideimide, high temperature nylons, certain aromatic copolyesters, such as produced by Carborundum under the tradename Ekkcel. Metals, such as stainless steel, might also provide suitable substrates providing they can be formed into thin sheets of film having the required properties at elevated temperatures. Typically, metals have relatively higher specific heat than polymer films, and accordingly, thinner sheets can be used to keep the total heat capacity of the belt within the desired range. Thus, a 0.5 mil stainless steel substrate might be used instead of the 2 mil polyimide film.

The substrate can be made reflective, which is desirable where the web will undergo radiant heating, by applying the suitable reflective coating thereon. Thin aluminum or gold coatings might be suitable, as well as others.

Suitable webs can have a wide variety of thicknesses, widths, etc. One typical web which has been found to have outstanding properties has a substrate 0.5–5 mils thick coated with an elastomer 0.1–10 mils thick, and preferably 0.5–2 mils thick. The reflecting layer is very thin, typically about 300 angstroms.

Additionally, it is an advantage to provide a transfer web designed to provide thermal efficiency in the transfer and fusing steps typically encountered in an electrophotographic process. Thus, materials, thicknesses, etc., are chosen to provide the member with a low heat capacity. This can be achieved by keeping each of the layers as thin as is consistent with the other parameters such as strength, and by using low specific heat materials. Preferred webs have total heat capacity, including all layers, of about $3.1 \times 10^{-3}$ calories/cm$^2$/°C or lower.

A more detailed description of suitable transfer webs is presented in copending application, U.S. Ser. No. 403,696, filed Oct. 4, 1973, the teaching of which are hereby incorporated by reference.

There are many equivalents to the embodiments specifically described herein which fall within the scope of the invention. Other means for disengaging drums and rollers from a transfer web can be used, for example, such as simply moving these out of contact with the web. Alternatively, rollers on the back side of the web could be moved out of contact therewith to effectively eliminate the nip at $T_1$ or $T_2$, thereby also serving to disengage the web. Additionally, many equivalent web materials, joining means, independent driving systems, etc. could be used. It is intended that such equivalents be covered by the following claims.

What is claimed is:

1. In an electrophotographic transfer apparatus wherein toner is transferred from the surface of a toner-bearing drum to a transfer web by pressure contact at a nip therebetween and subsequently transferred from the web to a support medium by feeding said support medium and said transfer web through a nip formed between transfer rollers, and wherein the transfer web is at least partially driven by means of the toner-bearing drum and transfer rollers, the improvement comprising providing:

means for simultaneously disengaging the nips at both said toner-bearing drum and at said transfer rollers from said transfer web at least once per web cycle; and, means for mechanically correcting transfer web alignment and registration while said nips are disengaged.

2. An electrophotographic apparatus of claim 1 wherein said means for mechanically correcting transfer web alignment and registration comprise independent means for driving said transfer web.

3. An electrophotographic transfer apparatus of claim 2 wherein said toner-bearing drum comprises a drum having a photoconductive surface.

4. An electrophotographic transfer apparatus of claim 3 wherein said means for simultaneously disengaging includes an indented surface on said photoconductive drum.

5. An electrophotographic transfer apparatus of claim 4 wherein said means for simultaneously disengaging includes a transfer roller having an indented surface.

6. An electrophotographic transfer apparatus of claim 5 wherein said transfer web has a plurality of segments fastened by joints to said independent means for driving the transfer web, and said joints are synchronized to meet the indentations on the photoconductive drum and transfer roller during each web cycle.

7. An electrophotographic transfer apparatus of claim 6 wherein said independent means for driving comprises a chain drive.

8. An electrophotographic transfer apparatus of claim 7 wherein said transfer web has an elastomeric surface.

9. An electrophotographic transfer apparatus of claim 7 wherein said transfer web has a smooth, elastomeric surface with a surface free energy of below about 40 dynes/cm., and a hardness of from about 3 to 70 durometers.

10. An electrophotographic transfer apparatus of claim 9 wherein said transfer belt is divided into two segments.

11. An electrophotographic transfer apparatus of claim 10 wherein each of the belt segments has a length substantially equal to the periphery of the photoconductive drum.

12. In an electrophotographic transfer apparatus wherein toner is transferred from the surface of a toner-bearing member to a transfer web by pressure contact at a first roller nip and subsequently transferred from the web to a support medium by feeding said support medium and said transfer web through a second roller nip, the improvement comprising:

a. means for disengaging at least one of said nips from time to time during the operation of said transfer apparatus; and b. means for automatically adjusting transfer web positioning during the disengagement of at least one of said nips.

13. The apparatus as set forth in claim 12 wherein said means for automatically adjusting transfer web positioning comprises a web driving means and wherein one web portion is coupled to said web driving means via a first coupler and another web portion is coupled to said driving device via a second coupler, and wherein at least one of said couplers includes a spring member.

14. The apparatus as set forth in claim 13 further including means for simultaneously disengaging said first and second nips.

15. The transfer apparatus of claim 12 wherein said means for disengaging at least one of said nips includes an indented roller.

16. The transfer apparatus of claim 13 wherein said means for disengaging at least one of said nips includes an indented roller.

* * * * *